US005951102A

United States Patent [19]

Poulson et al.

[11] Patent Number: 5,951,102

[45] Date of Patent: Sep. 14, 1999

[54] HIGH CHAIR

[75] Inventors: Keith L. Poulson, Westminster; Eduardo J. Jimenez; Joseph L. Kapushion, both of Thornton, all of Colo.

[73] Assignee: Evenflo Company, Inc., Vandalia, Ohio

[21] Appl. No.: 08/773,817

[22] Filed: Dec. 27, 1996

[51] Int. Cl.[6] ..... A47C 13/00

[52] U.S. Cl. ..... 297/130; 297/151; 297/153; 297/327; 297/344.14; 297/440.16; 297/467

[58] Field of Search ..... 297/325, 326, 297/327, 328, 467, 256.15, 256.16, 134, 130, 344.14, 440.2, 440.21, 440.16, 16.1, 148, 151, 149, 153, 344.18, 487, 440.22, 344.12, 452.18, 452.2

[56] References Cited

U.S. PATENT DOCUMENTS

| | | | |
|---|---|---|---|
| D. 344,189 | 2/1994 | Golenz et al. | D6/339 |
| D. 364,746 | 12/1995 | Lerner et al. | D6/339 |
| D. 374,125 | 10/1996 | Bernstein et al. | D6/333 |
| 1,082,884 | 12/1913 | Leonard . | |
| 2,560,708 | 7/1951 | Titus . | |
| 2,667,207 | 1/1954 | Magyar . | |
| 2,728,374 | 12/1955 | Whalen . | |
| 2,731,072 | 1/1956 | Post . | |
| 2,834,404 | 5/1958 | Groome . | |
| 2,934,135 | 4/1960 | Lesh . | |
| 2,971,567 | 2/1961 | Kimmel . | |
| 3,825,302 | 7/1974 | Kurtz . | |
| 3,894,496 | 7/1975 | Phillips et al. . | |
| 4,065,175 | 12/1977 | Perego . | |
| 4,582,359 | 4/1986 | Wise et al. | 297/151 |
| 4,722,570 | 2/1988 | Bertoli . | |
| 4,723,813 | 2/1988 | Kassai | 297/153 |
| 4,807,928 | 2/1989 | Cone . | |
| 4,842,331 | 6/1989 | Waples | 297/149 |
| 4,893,827 | 1/1990 | Gay et al. . | |
| 4,915,446 | 4/1990 | Darling et al. . | |
| 4,968,092 | 11/1990 | Giambrone | 297/151 |
| 5,104,180 | 4/1992 | Takahashi et al. . | |
| 5,118,161 | 6/1992 | Slowe et al. | 297/153 |
| 5,165,755 | 11/1992 | Rho . | |
| 5,170,720 | 12/1992 | Scheurer . | |

(List continued on next page.)

FOREIGN PATENT DOCUMENTS

| | | |
|---|---|---|
| 662204 | 4/1963 | Canada . |
| 3304894 | 10/1983 | Germany . |

*Primary Examiner*—Milton Nelson, Jr.
*Attorney, Agent, or Firm*—Robert G. Crouch; Holland & Hart LLP

[57] ABSTRACT

A high chair which includes a removable tray with a single-handed actuation handle for actuating a release mechanism. The actuation handle is located on the front edge of the tray and can be pushed slightly forward to operate the release mechanism which pivots fingers out of engagement with grooves located on the sides of the seat of the high chair. The seat can be removed from the high chair by actuating a latch located on a bottom side thereof and pivoting it slightly while lifting off to disengage notches defined on the back of the seat from an upper tubular member of a cradle which is attached to a frame and supports the seat thereon. The cradle can be pivoted relative to the frame to provide a plurality of positions for the seat, including an upright and a recline position. A pivoting mechanism includes a pair of nested hubs and a pin which selectively locks the hubs together. The cradle can be adjusted in height relative to the frame by actuation of a button and pin arrangement which engages with openings in a frame member. The frame can be securely placed into either an operational or a storage position by pivoting the rear frame member and allowing a latch to be operated to secure the rear frame member in either the operational or storage position.

23 Claims, 10 Drawing Sheets

U.S. PATENT DOCUMENTS 5,183,311 2/1993 Meeker et al. ..... 297/151
5,238,292 8/1993 Golenz et al. ..... 297/153
5,346,279 9/1994 Pecovella .
5,348,374 9/1994 Kuo ..... 297/344.18
5,445,432 8/1995 Chien .
5,468,051 11/1995 Huang ..... 297/344.18
5,474,355 12/1995 Lerner et al. ..... 297/36
5,489,138 2/1996 Mariol et al. ..... 297/151
5,498,065 3/1996 Tosoni .
5,507,550 4/1996 Maloney .
5,558,400 9/1996 Poulson et al. ..... 297/344.18
5,642,917 7/1997 Geiger .

HIGH CHAIR

The present invention relates to an improved high chair for children, and in particular, to a high chair which is convertible to a booster seat, a high chair which is pivotable between an upright and a recline position, and a high chair with an improved technique for attaching and detaching a tray therefrom.

BACKGROUND OF THE INVENTION

High chairs for use in feeding children are well known and can be found in a variety of different styles. Typically, such high chairs include a seat with a seat bottom, a seat back, and some form of side barriers. The seat typically is supported by four legs affixed thereto. A detachable tray normally provided with the high chair is either selectively attachable and detachable from both arms of the chair for complete removal of the tray or is pivotably attached to one arm and attachable and detachable from the opposite arm so that the tray can be pivoted off of the child to allow the child to be removed from the high chair. In order to prevent the child from slipping or submarining out of the chair underneath the tray, some high chairs include some sort of restraint system which is typically a belt and buckle arrangement for fastening about the waist of the infant and preventing movement of the infant out of the seat without disconnecting the belt system. As used herein, the term infant may apply to young children generally and not just to children less than two years of age.

Another type of seat used for feeding children is commonly known as a booster seat and includes a seat bottom, a seat back, and possibly side barriers. The booster seat is typically placed on an adult-sized chair and may serve to "boost" the child up to an appropriate height for eating at a table. Such booster seats typically do not include legs to support the seat. Generally, booster seats may be used by children up to four years of age or more, while high chairs may typically be used for children up to roughly two years of age.

Another type of seating arrangement to allow a child to eat at a counter or table is a clip-on seat, which includes a seat having a seat bottom, a seat back, and side barriers, with elongated arms extending from the side barriers. The elongated arms have portions which are placed above the planar surface of the table and have other portions which are placed below the planar surface of the table to grasp the table between the portions of the extended arms.

At least one design, disclosed in U.S. Pat. No. 5,348,374, includes a high chair in of which a seat is removable from the high chair for use as a clip-on seat or, possibly, as a booster seat. The arrangement for coupling or attaching and detaching the seat from the vertically-oriented frame is rather complex and cumbersome, however. This arrangement includes a pair of parallel flanges on the frame with aligned notches defined thereon which receive a tubular member located on the back of the seat. The flanges also include protuberances thereon which engage with notches defined in the seat back. When the tubular member on the seat has been placed within the notches on the frame and the protuberances have been located within the notches in the seat, a latch on the coupling member attached to the frame can be rotated into latching position to prevent accidental detachment of the seat from the frame. As can be seen, the chair must be engaged and disengaged from the frame by actuating this latch located on the rear portion of the seat. This latch is located in a position which is probably not easily accessible by an operator who is standing in front of the high chair. In addition, in order to remove the high chair from the frame, it is apparently necessary to first rotate the latch into a disengaged position and then for the operator to reposition his or her hands to gripping positions on the seat so as to lift the seat off of the frame. Another drawback of this design is that an auxiliary support which is pivotably connected to the back edge of the seat bottom must be pivoted into an extended position when it is desired to place the seat on top of a planar surface for possible use as a booster seat. This is required because of an extended foot rest which extends down from the front edge of the seat bottom. Thus, it can be seen that conversion of the design from a high chair to a booster seat is an inconvenient, multi-step process.

The removal of the tray from the high chair in most designs is typically accomplished by actuating release mechanisms on each of the two sides of the tray so as to disengage the tray from each of the arms of the high chair. One design, however, disclosed in U.S. Pat. No. 5,118,161 includes release mechanisms for a tray which can be actuated with a single hand of the operator. This mechanism includes an arcuate handle or pivot bar which is pivotably mounted to the underside of the tray. Springs are located between the handle and the underside of the tray to bias the front portion of the handle downward away from the tray. When the handle is in its biased position, a pair of pins, one located on either end of the handle, engage with grooves in the underside of the arms of the high chair. When the front portion of the handle is moved against its bias toward the underside of the tray, the pins are disengaged from the grooves in the arms of the high chair. When disengaged in this fashion, the tray can be slid off of the arms of the high chair via guide clips provided on the underside of the tray. Thus, the tray can be selectively engaged or disengaged with the high chair by actuating the handle with a single hand of the operator toward the underside of the tray and sliding the tray on or off of the high chair. This design includes at least three significant drawbacks. First of all, because of the nature of the engagement and the disengagement of the pins with the grooves and the slidable connection of the tray to the arms provided by the guide clips, it is necessary to carefully and properly position the tray on the high chair so that the elongated portions of the arms are received within the guide clips of the tray. In addition, when the tray is to be engaged or disengaged, it must be slid onto or off of the arms of the high chair. Second, the lever arm is hidden below the tray and may not be noticed or easily found by some operators. The third drawback comes from the inherent nature of the lever arm provided by the handle. When the handle or pivot bar is grasped on the sides of the tray, it may be difficult to pivot the bar sufficiently to disengage the pins from the grooves on the arms of the high chair.

Some modern high chairs are provided with an ability to adjust the angle of the seat of the high chair relative to the frame. Unfortunately most of these high chairs are difficult to adjust due to cumbersome and inconvenient recline mechanisms.

It is against this background and the desire to solve the problems of the prior art that the present invention has been developed.

SUMMARY OF THE INVENTION

Accordingly, it is an object of the present invention to provide an improved design for a high chair.

It is also an object of the present invention to provide an improved high chair in which the seat is pivotable between a plurality of seating positions for the child.

It is further an object of the present invention to provide an improved pivotable seat in a high chair which is also height adjustable.

It is still further an object of the present invention to provide an improved high chair in which the seat portion is easily and conveniently removable for use as a booster chair.

It is still further an object of the present invention to provide a high chair convertible to a booster chair, in which the booster chair can be converted between different types of booster chairs having different heights for the seat backs.

It is also an object of the present invention to provide an improved technique for removably attaching and detaching a tray to and from a high chair.

It is further an object of the present invention to provide an improved center guard on the tray to prevent the child from slipping underneath the tray of the high chair.

It is still further an object of the present invention to provide a retractable center guard for a tray.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to a high chair for children including a main frame, a support frame attachable to the main frame, and a seat engageable and disengageable with the support frame to support the seat from beneath the seat.

The high chair may also include a tray which is removably attachable to the seat. The tray may include a protruding member sufficiently large enough to block the passage of a child thereby, attachable to and extending downward from an underside of the tray. The protruding member may be movable between an extended position and a retracted position. The protruding member may be yieldingly biased toward the extended position. The seat may include indentations defined thereon for engagement with the tray, wherein the tray includes an actuation member and a release member which are pivotably attached together, the release mechanism including an engaging member to engage with the indentations on the seat and to disengage from the indentations when the actuation member is actuated. The tray may include two release mechanisms, one located on either side of the actuation member. The tray may also include a pair of side release members, one associated with each release member to release the release members in an alternative fashion from actuating the actuation member. The engaging member of the release mechanism may include two separate protrusions, spaced apart at a distance corresponding to the distance between two indentations in the seat. The distance between the two protrusions may correspond to the distance between two indentations having one empty indentation therebetween.

The seat may be removably attachable to the support frame with an attachment mechanism. The support frame may include an upper and a lower elongated horizontal member, and the attachment mechanism removably attaches the seat to the upper and lower members of the support frame. The attachment mechanism may be affixed to the seat and include a pair of recesses defined on the back of the seat to engage the upper member of the support frame and also include an engagement mechanism on the bottom of the seat to engage the lower member of the support frame. The engagement mechanism may be pivotably mounted to the bottom of the seat, movable between an engaging position and a disengaging position, and biased toward the engaging position, the engagement mechanism having an inclined bottom surface thereon to move the engagement mechanism toward the disengaging position when the seat is moved from a removed position toward the lower member of the support frame, the engagement mechanism moving against the bias toward the disengaging position due to the camming nature of the inclined surface and the pivotable mounting, the bias moving the engagement mechanism back toward the engaging position when the seat is sufficiently moved toward the lower member of the support frame. The engagement mechanism may include a recess defined on a back side thereof for engagement with the lower member of the support frame. The engagement mechanism may engage with the lower member of the support frame in a manner to self-tighten if the seat is lifted away from the lower tubular member without actuating the engagement mechanism. The engagement mechanism may be centrally disposed adjacent the front of the seat bottom.

The support frame may be slidably attachable to the main frame to allow the height of the support frame and the attached seat to be adjusted. The support frame may be pivotably attachable to the main frame, the support frame being pivotable between an upright and a reclined position. A latch mechanism may releasably secure the support frame in the upright or the reclined position. The latch mechanism may include a pair of nested members, one being mounted on the main frame and one being mounted on the support frame, and the latch mechanism further may include an extended member to connect the two nested members and prevent pivotable movement therebetween, the extended member being selectively removable from at least one of the two nested members to selectively allow pivotable movement therebetween. The pivotable movement of the support frame relative to the main frame may be prevented by a fastening member which securely attaches the support frame to the main frame until such time as the fastening member is removed. The high chair may further include a footrest attachable to the support frame to remain in attachment with the support frame when the seat is disengaged and removed from the support frame.

The present invention is also directed to a high chair for children including a frame with front and back frame members which are joined to each other at upper ends thereof and a seat removably attached to the frame with an attachment mechanism. The seat may be configured or use as a booster seat for children when the seat is removed from the high chair. The seat configurable as a booster seat may include an upper portion and a lower portion removably attached to each other, the lower portion including a seat bottom portion and a seat back portion, the upper portion including an extended seat back portion.

The present invention is also directed to a high chair for children including a frame with front and back frame members which are joined to each other at upper ends thereof, a seat attachable to the frame, and a right and a left connecting mechanism for joining together the upper ends of the front and back frame members. The connecting mechanisms have at least one of the front and back frame members pivotably connected thereto, to allow the frame to be moved between collapsed and extended positions. In the collapsed position, the front and back frame members are generally parallel to each other and in the extended position the front and back frame members are in an intersecting angular relationship to each other. At least one of the connecting mechanisms has associated with it a latch mechanism for releasably securing the front and back frame members into said parallel and intersecting relationships.

The latch mechanism may include at least two openings defined in the connecting mechanism and a button provided on one of the frame members which is biased outward from the frame member and is movable into the frame member, the button being selectably received in one of the at least two openings to releasably secure the frame members relative to each other.

The present invention is also directed to a convertible high chair and booster seat for children including a seat, a seat frame engageable and disengageable with the seat to support the seat from beneath the seat, and a floor frame connectable to the seat frame to support the seat frame above the floor.

The present invention is also directed to a removable tray for use with a seating member for children, the seating member having two side portions for engagement with the removable tray, the tray including a support surface for supporting various objects with the tray, the support surface having a front surface located on an opposite side of the tray from the occupant when the tray is attached to the seating member. The tray also includes an engagement mechanism attached to the tray below the support surface for engagement with the side portions of the seating member, the engagement mechanism including an actuation member extending outward from the support surface in the vicinity of the front surface and extending along substantially the entire width of the tray, the actuation member being actuable by moving the member inward to disengage the engagement mechanism.

The present invention is also directed to a tray for use with a feeding chair for children including a support surface for supporting various objects thereon, the support surface having a pair of opposite sides and a protruding member extending downward from the support surface at a position generally equidistant from the two sides to prevent the passage of a child under the tray. The protruding member may be retractably mounted to the support surface to allow the protruding member to be moved between a blocking position to prevent the passage of a child underneath the tray, and a non-blocking position to allow the tray to be placed on a planar surface such as a table while maintaining the support surface in an orientation generally parallel to the planar surface. The protruding member may be pivotably mounted to the support surface.

The present invention is also directed to a high chair for children including means for supporting the high chair, a seat operatively associated with the supporting means, and means attachable to the supporting means for selectively engaging with the seat and for supporting the seat from beneath the seat.

The present invention is also directed to a method of converting a freestanding high chair for children to a booster seat for children which rests on an external support surface such as a chair or table. The method includes the steps of providing a high chair including a frame and a seat selectively engageable with the high chair, disengaging the seat from the frame, and placing the seat directly onto the support surface.

The present invention is also directed to a high chair for children including means for supporting the high chair, a seat supported by the supporting means, and means associated with the supporting means and the seat for allowing the seat to be pivoted relative to the seat between a plurality of seating positions.

The present invention is also directed to a high chair for children including means for supporting the high chair, a seat supported by the supporting means, and means associated with the supporting means and the seat for allowing the seat to be moved relative to the supporting means to adjust the height of the seat relative to the supporting means.

The present invention is also directed to a high chair for children including means for supporting the high chair, a seat supported by the supporting means, a tray attachable to the seat, and means associated with the tray and the seat for allowing the tray to be engaged and disengaged with the seat for allowing the tray to be lifted upward off of the seat after being disengaged.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
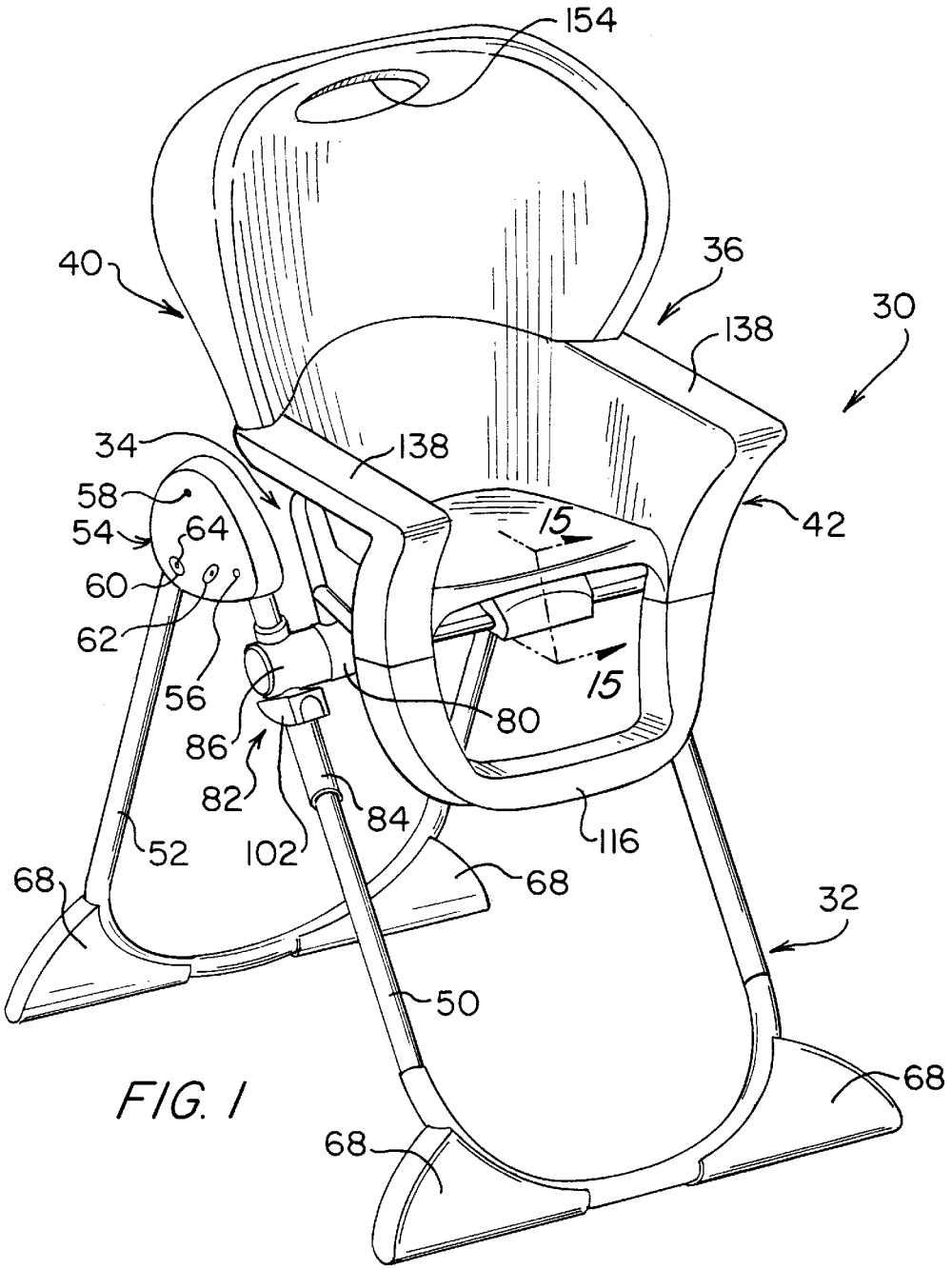
FIG. 1 is a perspective view of the improved high chair of the present invention.
Figure 2:
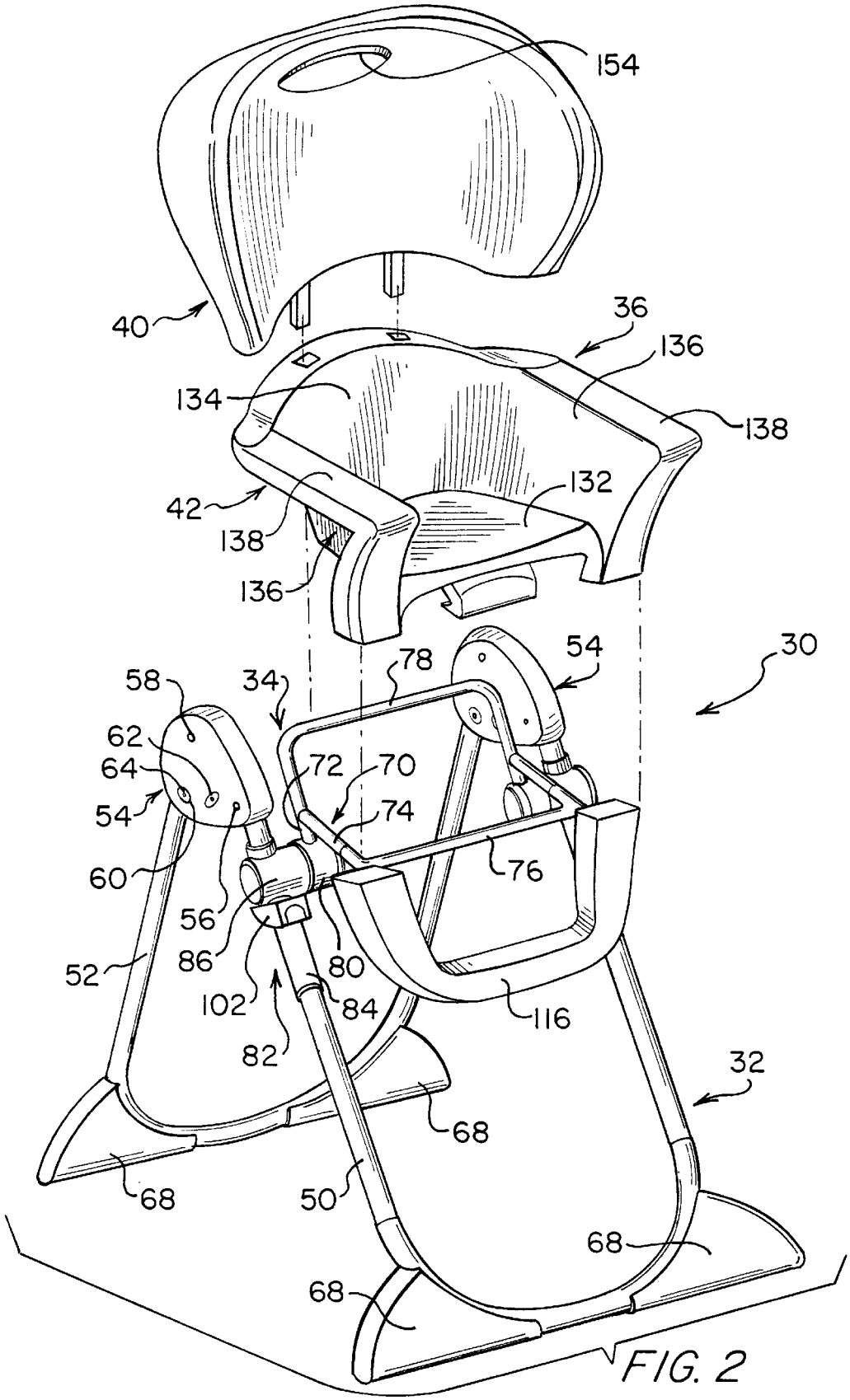
FIG. 2 is an exploded view of the high chair of FIG. 1.
Figure 3:
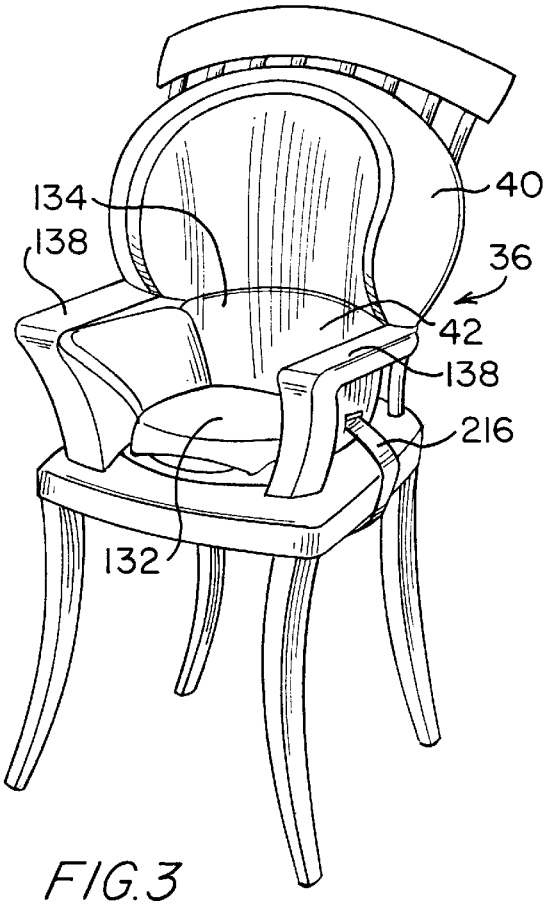
FIG. 3 is a perspective view of a seat portion of the high chair of FIG. 1 removed therefrom and placed on an adult chair for use as a booster seat.
Figure 4:
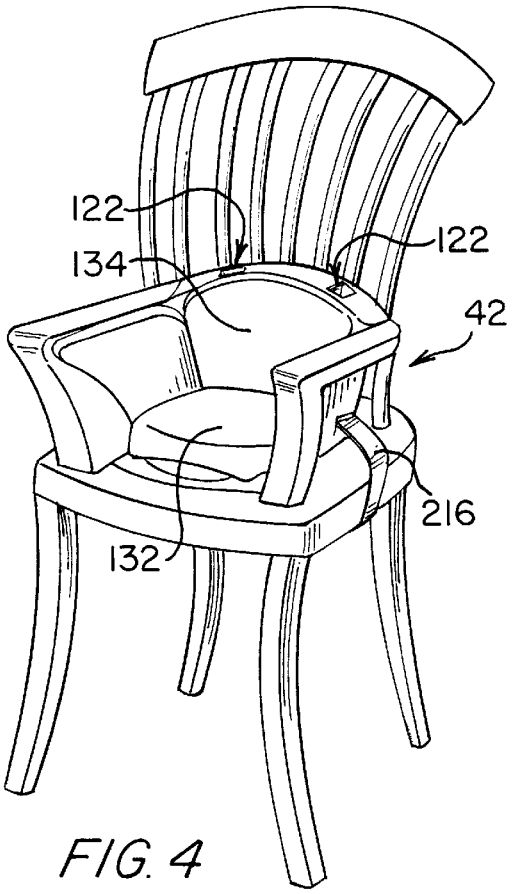
FIG. 4 is a view similar to FIG. 3 with an extended back portion of the seat removed for an alternative version of the booster seat.
Figure 5:
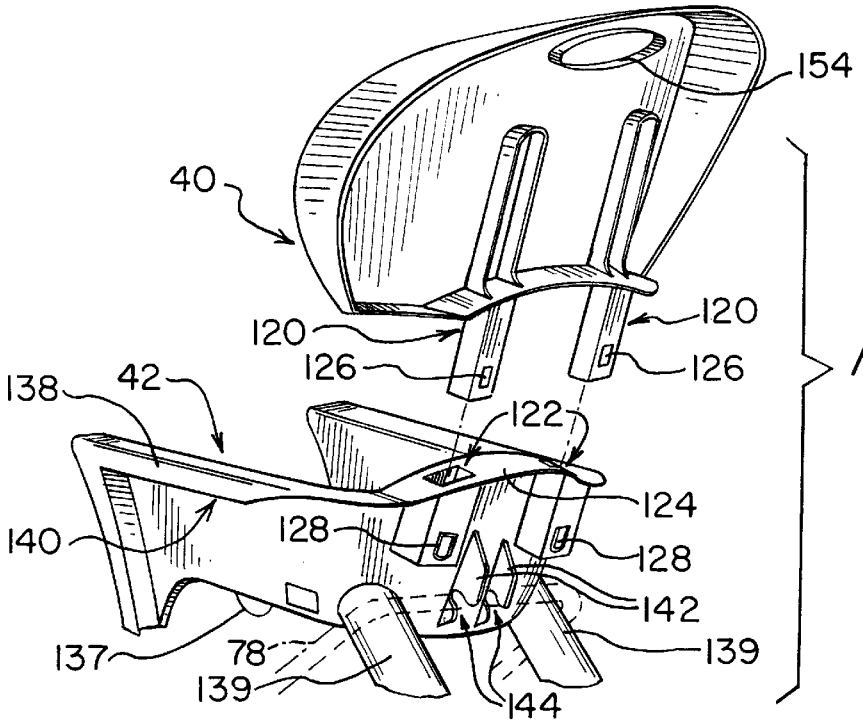
FIG. 5 is an exploded version of the booster seat of FIG. 3.
Figure 13:
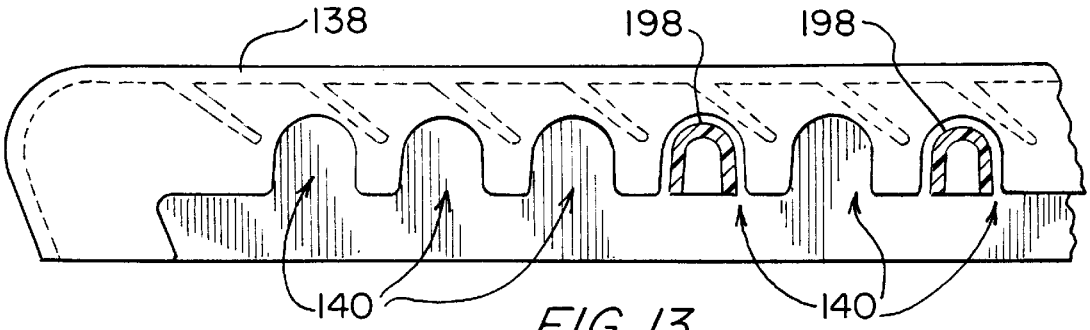
FIG. 13 is a close-up side view of one of the arms of the high chair of FIG. 1, showing grooves defined therein and a pair of fingers of one of the release mechanisms on the underside of the tray of FIG. 6 engaging with the grooves.
Figure 14:
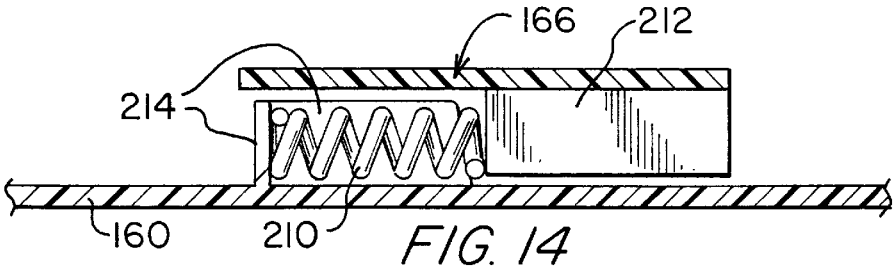
FIG. 14 is a cross-sectional view of the spring biasing arrangement for the handlebar portion on the underside of the tray of FIG. 6.
Figure 21:
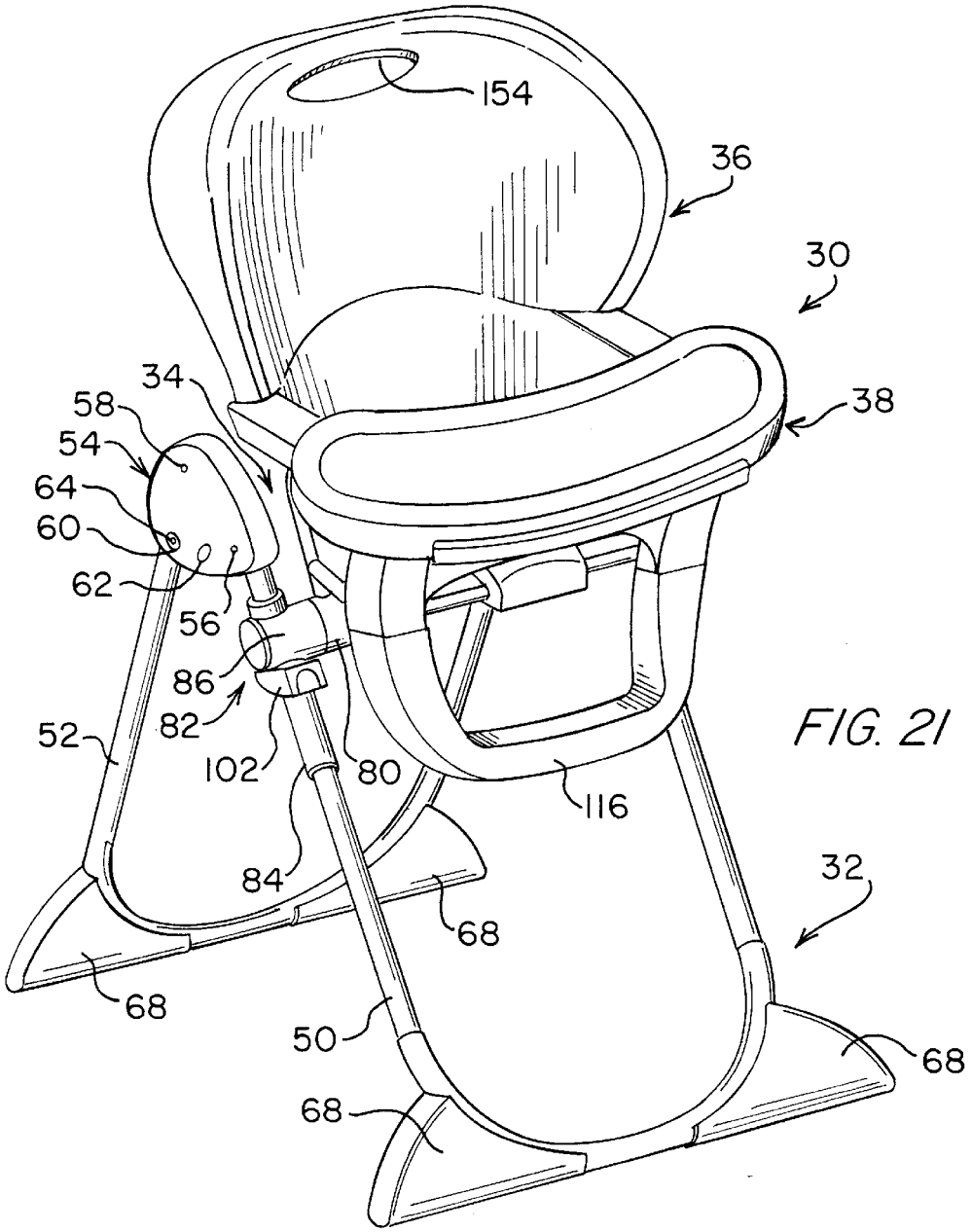
FIG. 21 is a view similar to FIG. 1, showing the tray attached to the seat of the high chair.

A high chair 30 of the present invention is shown in FIGS. 1 and 2. The high chair 30 includes a free-standing frame 32, a cradle 34 attached thereto, and a seat 36 supported by the cradle 34. A tray 38 (FIG. 6) is selectively attachable to and detachable from the seat 36, as is shown in FIGS. 13 and 21. As will be described in greater detail below, the cradle 34 is slidably and pivotably attached to the frame 32, so as to allow for adjustments of the angular position of the seat relative to the frame to be able to provide both an upright and a reclined position, as well as adjustable in height to provide for a desired height of the seat relative to a table or chair which may be located nearby. The seat 36 is removably attached to the cradle 34 so that the seat, when removed, can be used as a booster seat on an adult chair, as shown in FIGS. 3 and 4. Alternatively, the booster seat could be used on the floor or on other surfaces. As is shown in FIGS. 4 and 5, an upper portion 40 of the seat can be disconnected from a lower portion 42 of the seat 36 to provide for the lower profile booster seat shown in FIG. 4. The tray 38 may be removably attached to the seat 36, so that when the tray 38 is attached, an infant may be retained within the seat 36, and when tray 38 is removed, an infant can be removed from the seat 36.

The frame 32 (FIG. 2) includes a generally U-shaped front frame member 50 and a generally U-shaped rear frame member 52. Each of the front and rear frame members 50 and 52 are oriented with the closed portion of the U-shape along the ground and the open ends of the U-shape pointing upward. On each of the left and right sides of the frame 32, there is a connector 54 which connects the left sides of the frame members 50 and 52 together, and the right sides of the frame members 50 and 52 together. As the high chair 30 is generally symmetrical so that the left side is a mirror image of the right side, only one side may be described in detail in this and the remaining descriptions in this application. As shown best in FIG. 20, frame member 50 is attached to the connector 54 by any suitable attachment means, such as a screw 56, along a lower edge of the connector 54. The rear frame member 52 is pivotably attached to the connector 54 via any suitable fastening means, such as a screw 58, near the top of the frame member 52 and near the top of the connector 54. The attachment of the front frame member 50 to the connector 54 is at a spaced-apart distance from the end of the member 50. Due to the pivotable attachment of the rear frame member 52 to the connector 54, the rear frame member 52 is able to pivot between a position where the rear frame member 52 is angularly disposed relative to the front frame member 50 and a position where the rear frame member 52 is in a generally parallel relationship to the front frame member 50. In order to latch the frame member in a selected one of these angularly disposed and parallel positions, a pair of openings 60 and 62 are provided along the lower edge of the connector 54 so as to latch the rear frame member into the appropriate position at a corresponding location on the rear frame member 52 where a button assembly 64 is located thereon. The button assembly 64 may be a formed metal piece with a button on the end thereof, the metal piece acting as its own spring, such as a one-headed button available from Valco of North Royalton, Ohio, as Model No. A-163.

Figure 20:
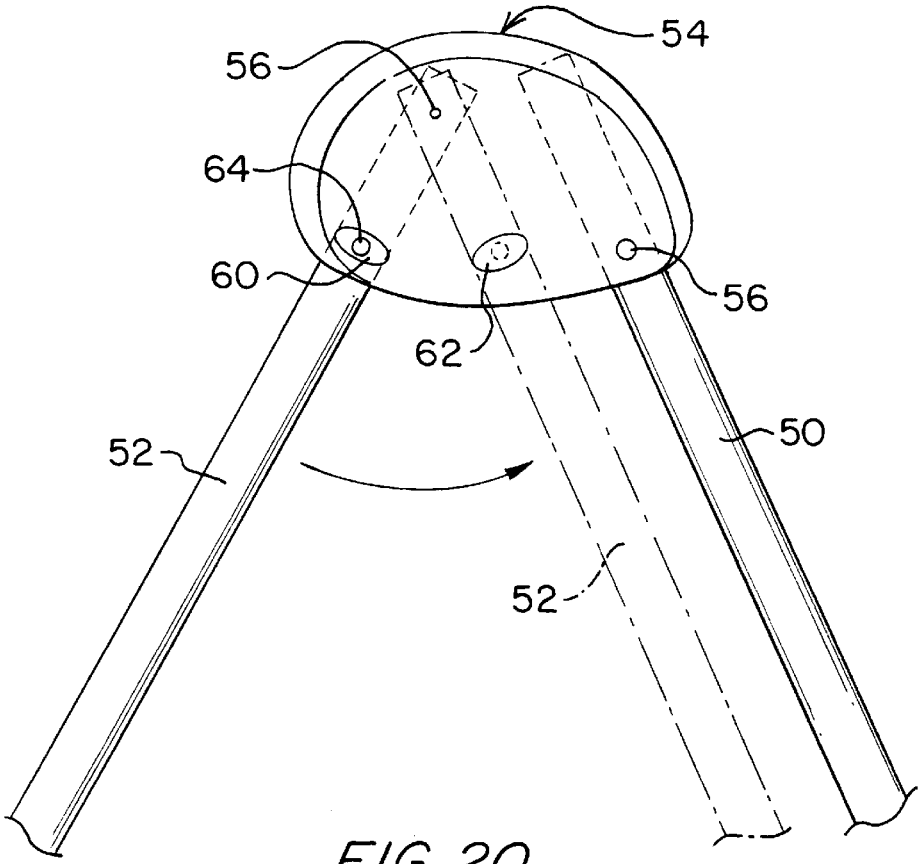
FIG. 20 is a close-up side view of one of the side frame connectors of the high chair shown in FIG. 1, showing two frame members in an extended and locked position relative to each other and showing in phantom one of the frame members in a retracted and locked position relative to the other frame member.

In order to stabilize the high chair 30 and the frame 32 and to substantially reduce side-to-side motions thereof including reducing the potential for tipping, a pair of side feet 68 are provided on each of the front and rear frame members 50 and 52, as shown in FIGS. 1, 2, and 20. The side feet 68 are attached to the frame members 50 and 52 along opposite sides of the closed end of the U-shape and, thus, along the floor or ground. Alternatively, the rear frame member 52 could be provided with wheels (not shown) which are attached to the feet 68 in a position where the wheel does not touch the ground when the feet 68 are all on the ground. When there is no infant in the high chair 30, the entire chair 30 can be tilted back sufficiently to where the wheels come into contact with the ground and support the chair 30 thereon to easily move the chair 30 to another location. This arrangement is disclosed and discussed more fully in a patent application entitled "Improved Swing," filed herewith and assigned to the assignee of the present invention, referred to as Docket No. 17497-5 in the law offices of Chrisman, Bynum, & Johnson, U.S. patent application Ser. No. 08/774,217, which is incorporated herein by reference.

Figure 19:
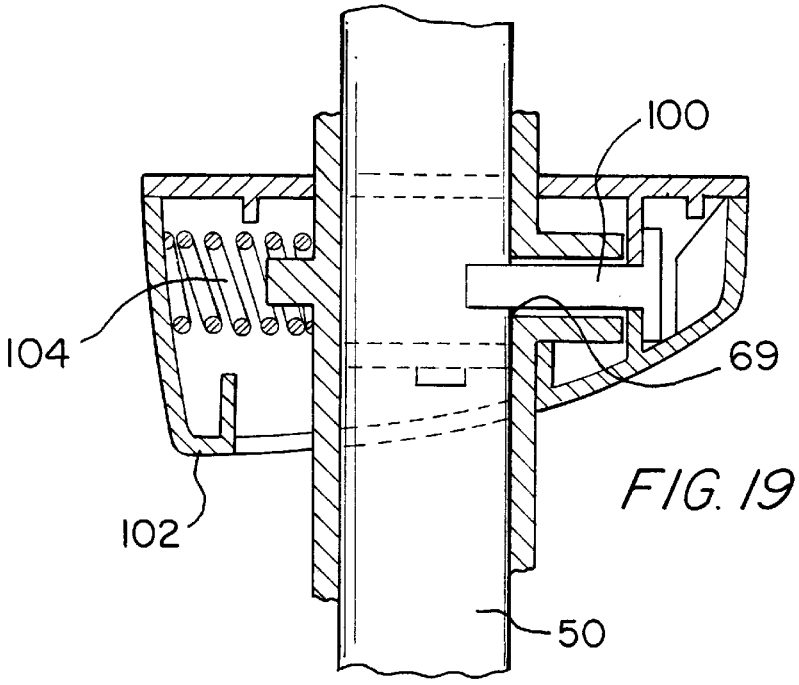
FIG. 19 is a cross-sectional view of the height adjustment mechanism shown in FIG. 16.

For engagement with the cradle 34, the front frame member 50 includes a series of spaced-apart openings 69 (FIG. 19) defined on a backside thereof below the attachment point to the connector 54 and extending approximately one-half of the way down each of the sides of the front frame member 50. These openings are disclosed and discussed more fully in U.S. Pat. No. 5,238,292, assigned to the assignee of the present invention and which is incorporated herein by reference.

Figure 16:
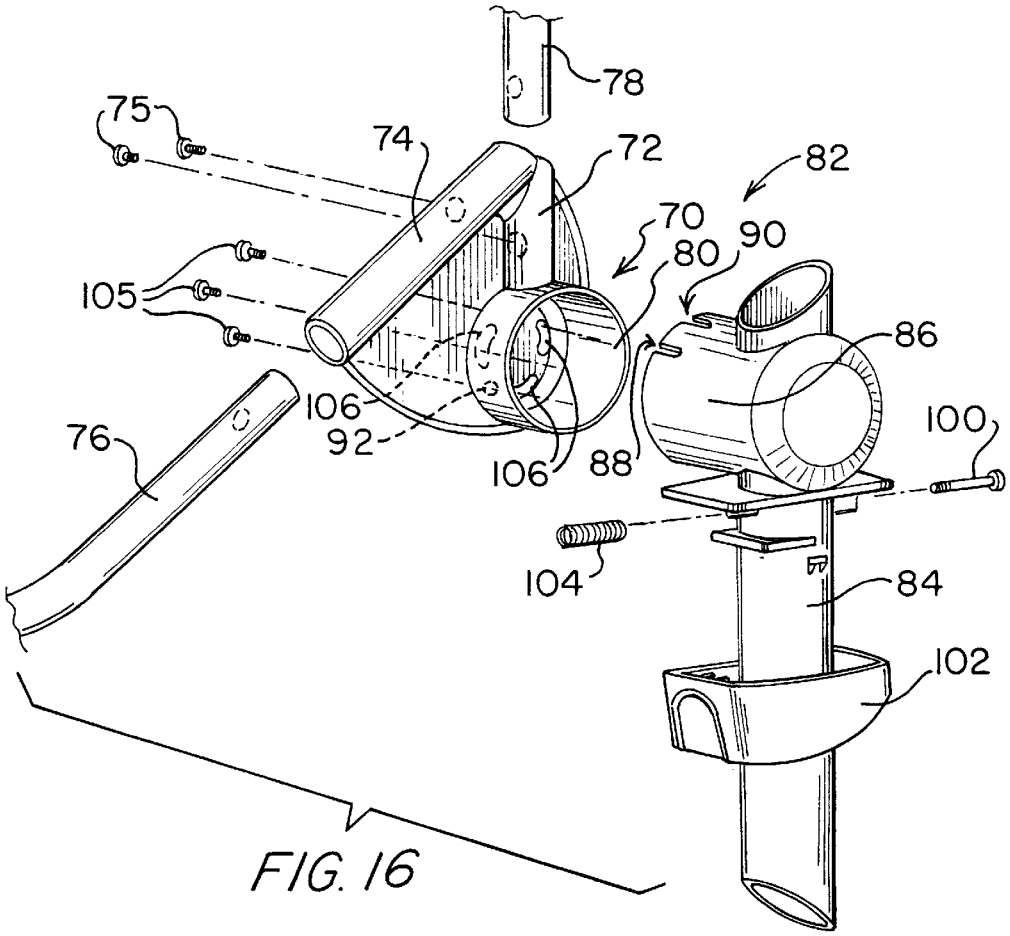
FIG. 16 is a close-up exploded view of a pivoting and height adjustment mechanism located on one side of the high chair of FIG. 1.
Figure 17:
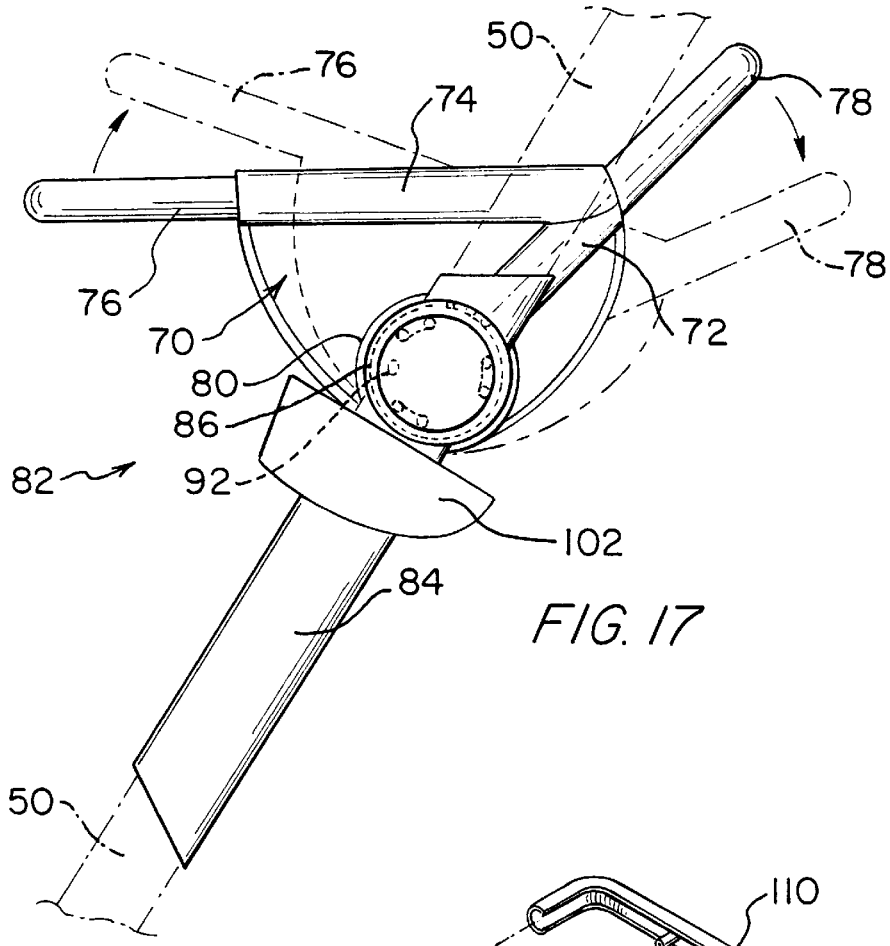
FIG. 17 is a side view of the pivoting and height adjustment mechanism, showing the cradle in an upright position, and showing in phantom the cradle in a reclined position.

The cradle 34, shown in FIG. 2, is composed of a plurality of tubular members joined together in a frame-like arrangement to support the seat 36. A generally U-shaped lower tubular member 76 for supporting the bottom of the seat 36 is joined to a generally U-shaped upper tubular member 78 for supporting the back of the seat 36. Preferably, the tubular members 76 and 78 may be composed of steel. The ends of the upper tubular member 78 are attached together by attachment to a joint 70 (FIGS. 16 and 17). The joint 70 includes tubes 72 and 74 defined thereon which receive ends of the tubular members 76 and 78 and screws 75 for attachment thereto. The joint 70 also includes a cradle hub 80 defined thereon which is part of a pivoting and height adjustment mechanism 82 employed for attachment of the cradle 34 to the frame 32. Preferably, the joint 70 may be composed of plastic.

Figure 22:
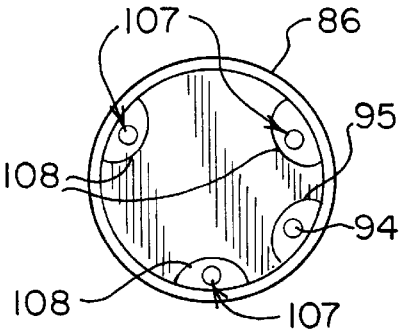
FIG. 22 is a side view of a frame hub of the pivoting and height adjustment mechanism of FIG. 16.

The adjustment mechanism 82, shown in FIGS. 2, 16, and 17, is slidably received on the front frame member 50 of the frame 32. The adjustment mechanism 82, shown in FIG. 16, also includes a main sleeve 84 with a frame hub 86 molded thereon. Preferably, the frame hub 86 and sleeve 84 assembly are composed of plastic. The frame hub 86 includes a plurality of openings 88 and 90 defined therein for selectively locking the cradle hub 80 thereto. The cradle hub 80 includes an opening 92 defined on an end thereof for selectively receiving an attachment device such as a screw (not shown) for affixing the cradle hub 80 to the frame hub 86 via a third opening 94 defined on a boss protruding into the frame hub 86. The hubs are also connected together by screws 105 received within arcuate-shaped openings 106 and engaging with openings 107 (FIG. 22) defined on bosses 108 protruding into the frame hub 86. When the hubs 80 and 86 are affixed together in this manner, pivotable movement of the cradle 34 relative to the frame 32 is not possible. Alternatively, the screw (not shown) which connects the hubs 80 and 86 together via the openings 92 and 94, respectively thereon, can be omitted and the hubs are free to pivot relative to each other through an angle determined by the length of the arc defined by the arcuate-shaped slots 106. The frame hub 86 can then be selectively affixed to the cradle hub 80 by a pin 96 (FIG. 18) slidably received within the upper tubular member 78 and protruding through a corresponding opening (not shown) defined in the cradle hub 80 to engage with the frame hub 86 through either of the previously mentioned openings 88 and 90. As can be appreciated, the location of one of the openings 88 is located so as to provide an upright position for the seat 36 in the high chair 30, while the location of the other of the openings 90 provides for a recline position of the seat 36 in the high chair 30. Instead of three bosses 108 (FIG. 22) which are spaced apart at angles of approximately 120 degrees, two bosses spaced apart at approximately 180 degrees could be employed.

Figure 18:
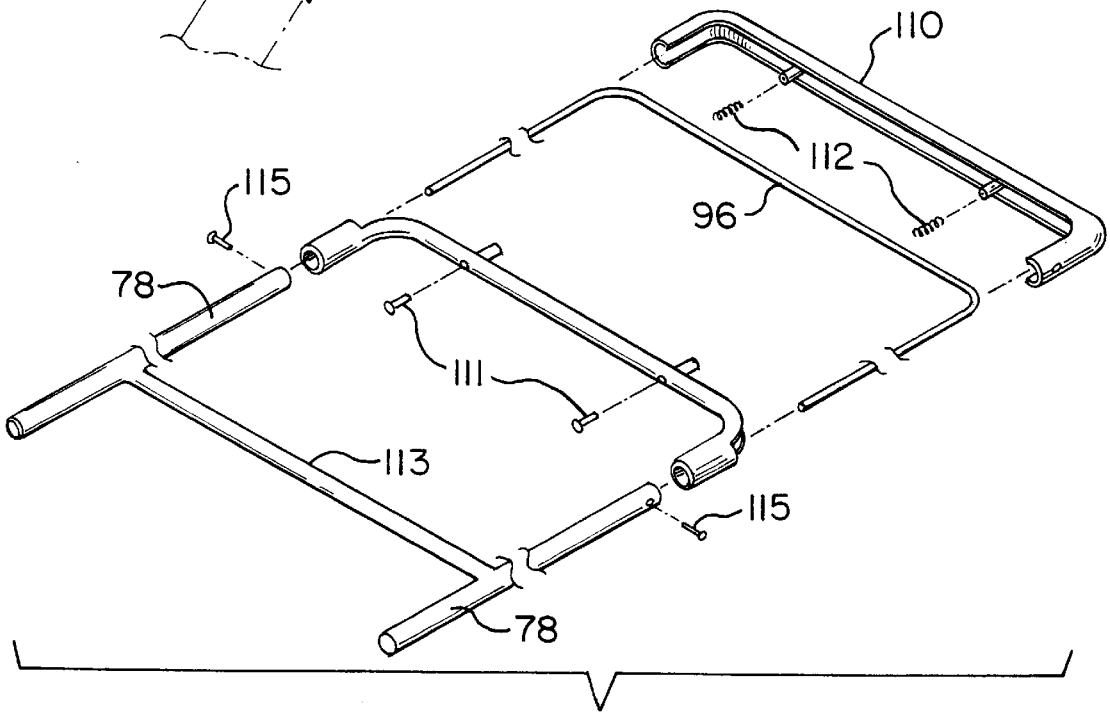
FIG. 18 is an exploded view of an actuation bar and pin arrangement for the pivoting and height adjustment mechanism shown in FIGS. 16 and 17.

The pin 96 which is used to selectively lock the hubs 80 and 86 together is formed in a generally U-shape and received within the upper tubular member 78, as shown in FIG. 18. A grip 114 for actuating the pin 96 is slidably received on the upper tubular member 78. The upper portion of the grip 114 is partially cut away so that the pin 96 can be placed therein. An upper handle 110 is attached to the upper tubular member 78 by screws 115 and to the grip 114 by screws 111 with a pair of springs 112 are placed between the pin 96 and the upper handle 110 to bias the pin 96 into an engaging position relative to hubs 80 and 86. Thus, the grip 114 can be moved relative to the upper handle 110 and the upper tubular member 78 to actuate the pin 96 relative to the hubs 80 and 86. Alternatively, it may only be necessary to use one spring 112. The upper tubular member 78 also includes a crossbar 113 defined thereon for engagement with the seat 36 as is described below in more detail.

Height adjustment of the adjustment mechanism 82 is provided by the movement of a pin 100 (FIGS. 16 and 19) in and out of engagement with one of the openings 69 on the back side of the front frame member 50 of the frame 32. As can be seen, the pin 100 is retained within a button housing 102 which is mounted on the main sleeve 84. The button housing 102 is biased, by a spring 104 retained within the button housing 102 on an opposite side from the pin 100, toward a position where the pin 100 engages with the front frame member 50.

As an option, a foot rest 116 (FIGS. 1, 2, and 21) can be fastened to the lower tubular member 76 of the cradle 34 in a position so that when the seat 36 is installed on the cradle 34, the foot rest 116 is aligned with the seat and in position to receive the feet of an infant placed in the high chair 30.

The seat 36 can best be seen in FIGS. 1–5. The upper portion 40 of the seat 36 includes a pair of fingers 120 (FIG. 5) which are slidably received within a pair of slots 122 defined in an upper surface 124 of the lower portion 42 of the seat 36. On a back side of and near the bottom edge of each of the fingers 120 are a pair of protruding tabs 126 which normally extend out from the fingers 120, but can be moved against their natural bias so as not to protrude from the fingers 120 when passing through the slots 122. Once the fingers 120 are completely removed from the slots, the protruding tabs 126 can again return to their normal biased protruding position. A pair of openings 128 are defined on the back side of the lower portion 42 of the seat 36 along the slots 122 therein. The protruding tabs 126 are able to protrude into the openings 128 when the upper portion 40 of the seat 36 is attached to the lower portion 42 of the seat 36. To release the upper portion 40 of the seat 36, the protruding tabs 126 are pushed against their bias so as not to protrude and the upper portion 40 of the seat 36 is lifted off the lower portion 42. Alternatively, the seat 36 may be a single integral unit which is not separable into an upper and a lower section.

The lower portion 42 of the seat 36 includes a seat bottom 132, a seat back 134, and a pair of sides 136, as seen in FIG. 2. On the bottom surface of the seat bottom 132, a protruding rib 137 (FIG. 15) helps to hold the seat 36 on the cradle 34. A pair of rear legs 139 (FIG. 5) are provided on the seat 36 which are angled diagonally backward to help prevent the seat from being tipped over when used separately from the high chair 30. The sides 136 are generally vertical in orientation and terminate in a horizontal rail 138 along an upper edge thereof. Defined along an underside of the horizontal rail 138 are a series of spaced-apart grooves 140 defined therein, as shown in FIG. 13, for engagement with the tray 38. The upper portion 40 of the seat 36 is curved about a vertical axis so as to provide conforming sidewalls to partially surround the child while in the high chair 30. Along an upper edge 154 of the upper portion 40, a handhold opening 154 is defined therein for ease of grasping the seat 36.

For engagement of the seat 36 with the cradle 34, the lower portion 42 of the seat 36 includes a pair of flanges 142 with downwardly angled notches 144 (FIG. 5) defined therein. These notches 144 engage with the upper tubular member 78 of the cradle 34. Alternatively, these notches 144 may be primarily horizontal rather than downwardly angled.

Figure 15:
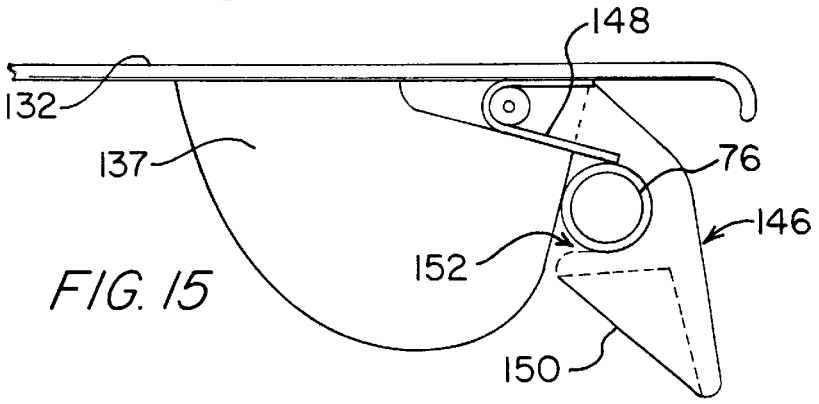
FIG. 15 is a side view of a latch located on the front of the seat bottom of the high chair shown in FIG. 1, showing the latch in an engaging position relative to a lower horizontal member of a cradle of the high chair.

A latch 146, best seen in FIG. 15, is pivotably attached to the bottom surface of the seat bottom 132 for engagement with the lower tubular member 76 of the cradle 34. A spring 148 provided between the latch 146 and the seat bottom 132 biases the latch in a clockwise direction as seen in FIG. 15. Thus, the spring 148 biases the latch 146 into an engaging position. The latch 146 may be disengaged from the lower tubular member 76 by actuating the latch 146 and causing it to pivot in a counter clockwise direction as viewed in FIG. 15 so that the latch 146 is no longer in engagement with the lower tubular member 76. An angularly disposed bottom surface 150 on the latch 146 is employed to cam the latch 146 against the bias of the spring 148 to pivot in the counter-clockwise direction, as viewed in FIG. 15, when the seat bottom 132 is moved toward the lower tubular member 76. When the bottom surface 150 first contacts the upper surface of the lower tubular member 76, the force associated with the downward movement of the seat bottom 132 toward the lower tubular member 76 will be converted into a force normal to the bottom surface 150. This force will counteract the force of the spring 148 and, if sufficient, will cause the latch 146 to pivot in a counter-clockwise direction, as viewed in FIG. 15, until the bottom surface 150 of the latch 146 has slid past and beneath the lower tubular member 76.

At this point, the force on the bottom surface 150 disappears, and the force of the spring 148 causes the latch 146 to pivot back in a clockwise direction, as viewed in FIG. 15, until the latch 146 fully engages with the lower tubular member 76 by receiving the lower tubular member 76 within a notch 152 defined in the back side of the latch 146.

Also, the latch 146 is designed to pivot further in a clockwise direction, as viewed in FIG. 15, if the seat bottom 132 is lifted upward away from the lower tubular member 76. This occurs due to the spring 148, the shape of the notch 152, and the positioning of the connection of the latch 146 to the seat bottom 132 relative to the positioning of the lower tubular member 76. This tendency provides a self-tightening effect to the latch 146, which provides additional security from unintended disengagement of the latch 146.

Figure 6:
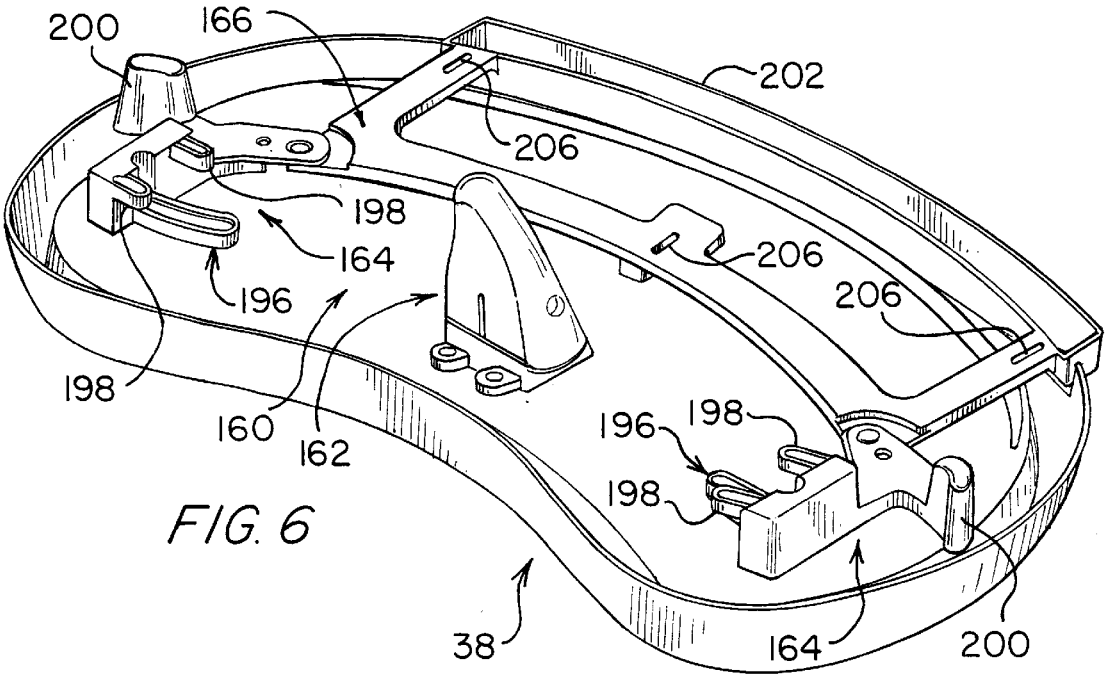
FIG. 6 is a perspective view of the underside of a tray of the present invention which may be selectively attached to the high chair of FIG. 1.
Figure 7:
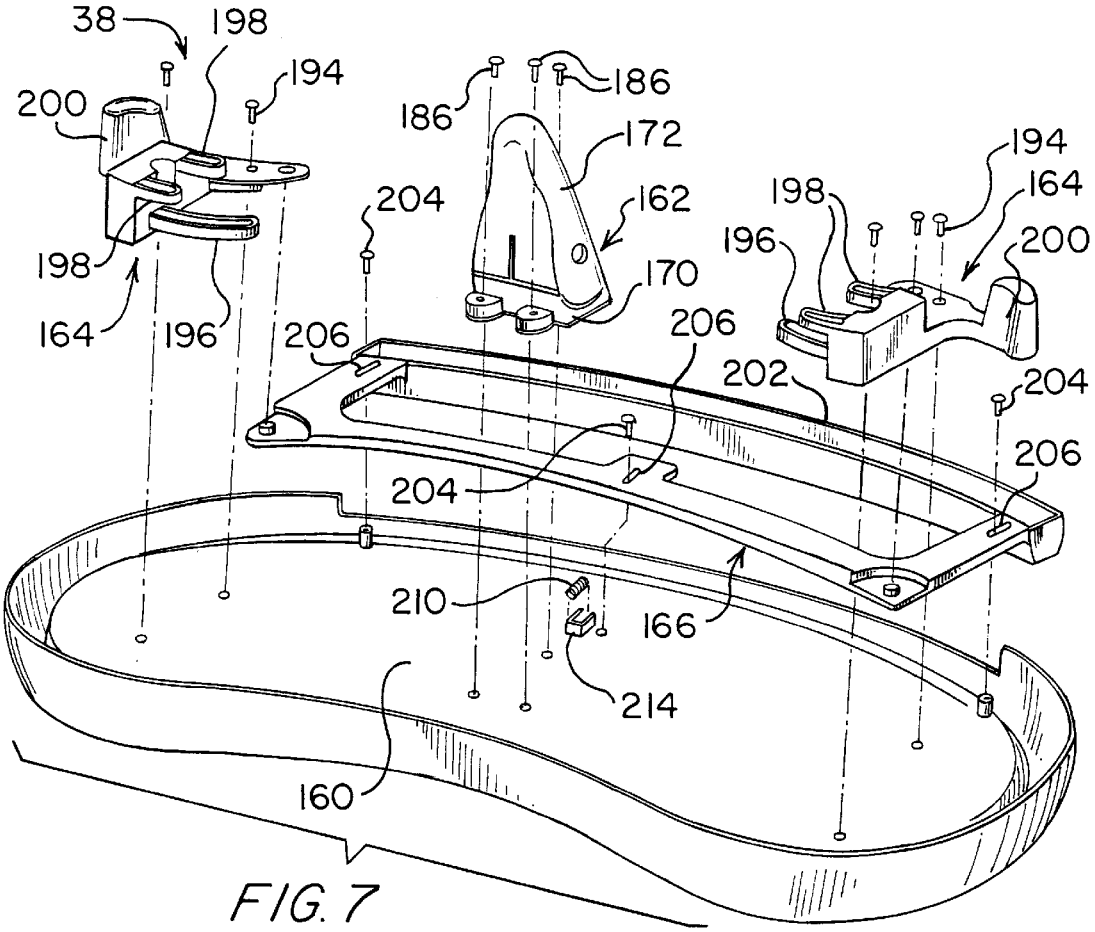
FIG. 7 is an exploded perspective view of the underside of the tray of FIG. 6.
Figure 9:
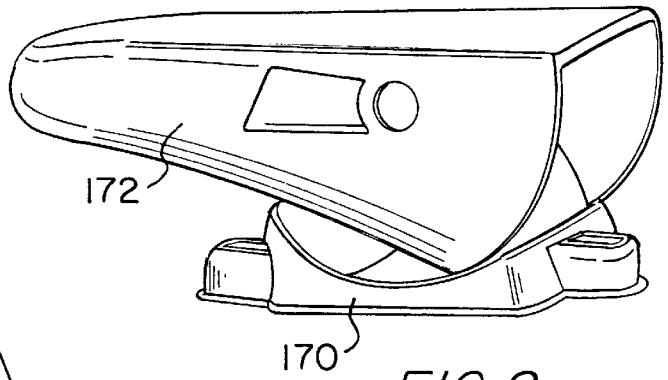
FIG. 9 is a perspective view of the center guard of FIG. 8, showing the center guard in a retracted position.
Figure 10:
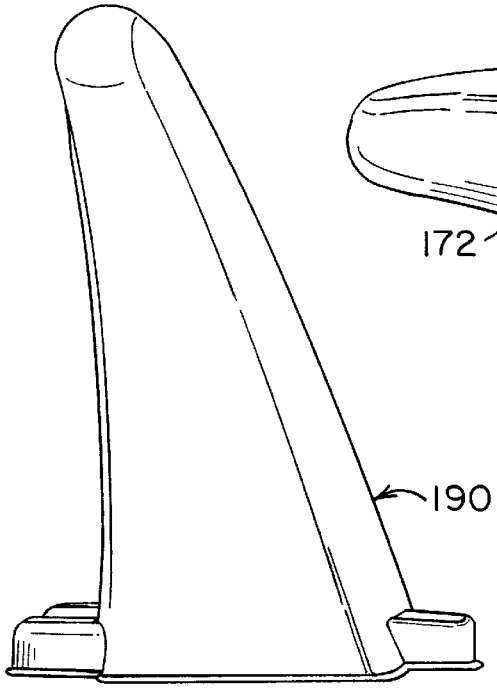
FIG. 10 is a perspective view of a fixed center guard which could alternatively be attached to the tray of FIG. 6 rather than the retractable center guard shown in FIG. 8.
Figure 8:
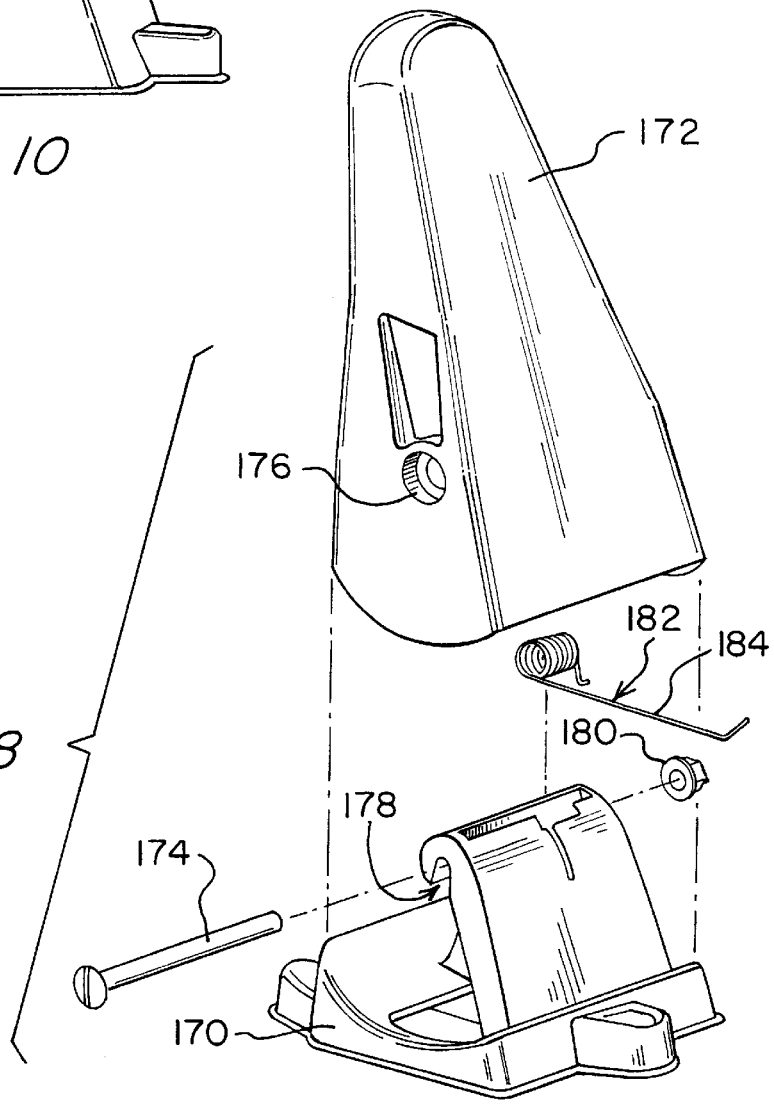
FIG. 8 is an exploded perspective view of a retractable center guard from the underside of the tray in FIG. 6.
Figure 11:
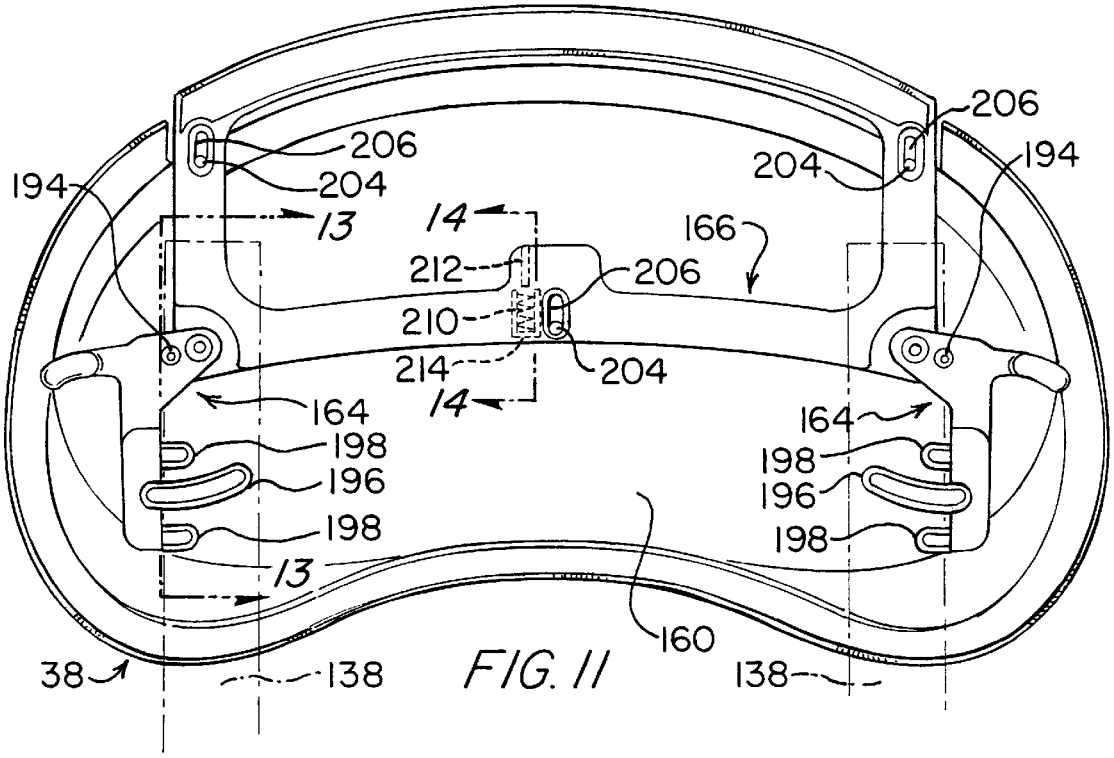
FIG. 11 is a top view of the underside of the tray of FIG. 6, showing a handlebar portion thereof in an extended position and showing a pair of release mechanisms in an engaging position.
Figure 12:
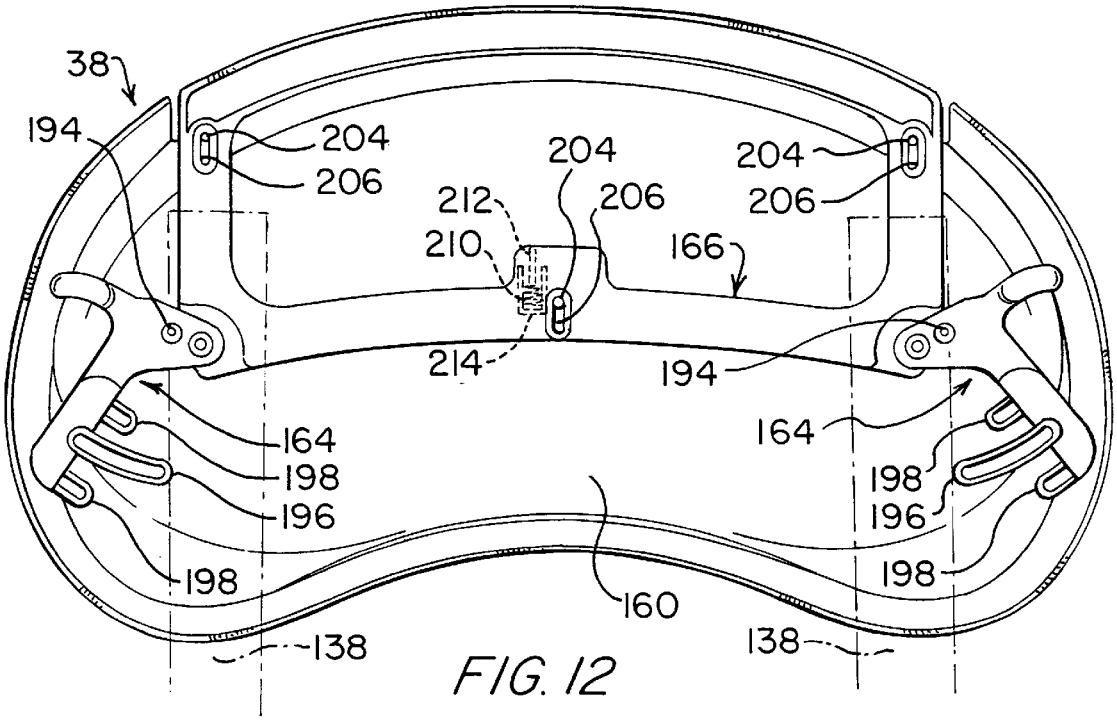
FIG. 12 is a view similar to the view of FIG. 11, showing the handlebar portion in a retracted position, and the release mechanisms in a non-engaging position.

The tray 38, or portions thereof, are shown in FIGS. 6–14. The tray 38 includes a tray base 160, a retractable center guard 162, a pair of release mechanisms 164, and a push bar 166 which actuates the release mechanisms 164. The center guard, shown in FIGS. 6–9, includes a guard base 170 to which a guard member 172 is pivotably attached with a pivot pin 174. The pivot pin 174 is inserted through corresponding openings 176 in the guard member 172 and engages with a slot 178 formed in the guard base 170. A cap 180 for the pivot pin 174 retains the pin 174 in position. Alternatively, there may be no need for the cap 180 as the pivot pin 174 may have grooves thereon (not shown) and be retained by friction fit. The guard member 172 is biased toward a substantially vertical position by a spring 182 retained within the guard base 170 and having an arm 184 acting against the guard member 172 to bias the guard member 172 toward an upright position relative to the tray base 160, as shown in FIG. 6. The center guard 162 may be fastened via the guard base 170 to the tray base 160 by suitable fastening means such as screws 186. Alternatively, the retractable center guard 162 can be replaced with a fixed center guard 190, as shown in FIG. 10. The fixed center guard 190 is an integral unit which is fastened to the tray base 160, as opposed to having a separate base 170 and guard member 172 which are pivotably connected together as with the retractable center guard 162.

Each of the release mechanisms 164 (FIGS. 6, 7, 11, and 12) act as levers. Each release mechanism 164 is pivotably attached to the tray base 160 by any suitable fastening means such as screws 194. The release mechanism includes a slide guide 196 defined thereon, the guide 196 including a slot defined in the middle thereof which receives a suitable fastening means such as a rivet or screw (not shown) attached to the tray base 160. As the release mechanism 164 is pivoted about the screw 194, the slide guide 196 and rivet serve to constrain the pivotable motion of the release mechanism 164 to be generally within a plane which is substantially horizontal and parallel to the tray base 160. Also located on the release mechanism 164 and at a position vertically offset from the slide guide 196 are a pair of fingers 198 which can selectively be engaged with the grooves 140 defined on the sides 136 of the seat 36. The spaced apart distance between the adjacent fingers 198 generally corresponds to the spacing between two grooves 140 (FIG. 13) on the side 136 of the seat 36. These two grooves 140 which would receive the fingers 198 have one unoccupied groove located therebetween. In other words, one finger 198 would engage with a groove 140, while the next adjacent groove 140 would be empty, and the next groove adjacent to that groove 140 would be occupied by the second finger 198, all as is shown in FIG. 13. The release mechanisms 164 can either be pivoted by actuating an extended release handle 200 defined thereon or by actuating the push bar 166. Of course, to release the tray 38 from the seat 36 with only the extended release handles 200, it may be necessary to actuate both handles 200. This action is consistent with the two-handed action required by most prior art trays and thus may be more comfortable for some operators.

For one-handed operation, the push bar 166 is pivotably attached to the release mechanism 164 adjacent to the pivotable attachment of the release mechanism 164 to the tray base 160. As can be appreciated in FIGS. 11 and 12, due to the much closer spacing between the pivotable connections of the release mechanism 164 to the push bar 166 and to the tray base 160 than the spacing between the fingers 198 and the connection to the tray base 160, a small amount of movement of the push bar 166 results in a large pivotable movement of the fingers 198 out of the grooves 140. The push bar is generally rectangular except that it includes a curved actuating handle 202 on a front side thereof. The actuating handle 202 is curved to blend aesthetically and smoothly with the front surface of the tray base 160. The push bar 166 is retained on the tray base 160 by a pair of suitable fastening devices such as screws 204 which are received within slots 206 defined in the push bar 166. The push bar 166 is biased, by a spring 210 retained between the tray base 160 and the push bar 166, in a direction which causes the actuating handle 202 to just slightly protrude from the front surface of the tray base 166. The spring 210 is compressed between a protruding feature 212 defined on the push bar 166 and a U-shaped feature 214 which protrudes from the tray base 160. Thus, the push bar 166 is normally biased toward a position where the fingers 198 of the release mechanisms 164 will engage with the grooves 140. When the push bar 166 is actuated against the force of the bias spring 210, the fingers 198 can be pivoted out of engagement with the grooves 140.

The plastic components of the high chair 30 should have sufficient strength and rigidity to perform the desired function. In the case of the connectors 54 this material may be ABS, while with most of the remaining plastic components this material may be polypropylene.

In operation, the various features of the high chair 30 can be operated as follows. To install and remove the tray 38 on and off of the seat 36, the tray is placed on top of the sides 136 of the seat while the actuating handle 202 is actuated against the bias of the spring 210. This can be easily performed with a single hand of an operator by grasping the tray base 160 in such a position as to actuate the actuating handle 202. With the release mechanisms 164 actuated to this disengaged position, and the release mechanisms 164 located adjacent to the grooves 140 defined in the sides 136 of the seat 36, the actuating handle 202 can be released so that the fingers 198 pivot into engagement with the grooves 140 to attach the tray 38 to the seat 36. When it is desired to remove the tray 38 from the seat 36 the tray 38 can be grasped with a single hand of the operator in such a position as to move the actuating handle 202 so as to pivot the release mechanisms 164. Once the fingers 198 are disengaged from the grooves 140, the tray 38 can be lifted off of the seat 36.

The seat 36 can be installed on the cradle 34 by first engaging the notches 144 with the upper tubular member 78 and then pivoting the seat 36 toward the lower tubular member 76 until the latch 146 is pivoted against its bias into a disengaging position and then snaps back into the engaging position. As can be appreciated, this installation can be easily performed with two hands and possibly with one hand without manual operation of any latches. In order to remove the seat 36 from the cradle 34, the latch 146 may be actuated with one hand of the operator while grasping the seat via the handhold opening 154 at the top of the seat 36. After the latch 146 is actuated, the seat 36 can be pivoted slightly and lifted off of the cradle 34. If desired, the seat 36 can then be used as booster seat on a conventional adult chair with or without the upper portion 40 of the seat 36 installed, as is shown in FIGS. 3 and 4, respectively. When used as a booster seat, a strap 216 can be employed to secure the booster seat to the adult chair.

When installed in the high chair 30, the seat 36 may be reclined relative to the frame 32 by actuating the pin 96 retained within the upper tubular member 78 of the cradle 34. By actuating and pulling the pin out of engagement with the frame hub 86, the cradle 34 is free to be pivoted relative to the frame hub 86 and frame 32. When the cradle 34 has been pivoted to the desired position, the pin 96 can be released and the springs 112 will cause the pin 96 to again lock the cradle hub 80 to the frame hub 86 and prevent further pivotable movement, assuming the cradle 34 has been moved to one of the predetermined aligned positions defined by the openings 88 and 90 in the hubs 80 and 86. Preferably, at least two sets of aligned openings are provided corresponding to an upright position and a reclined position for the seat 36. As can be appreciated in FIGS. 1, 2, 17, and 21, the pivotable connection between the hubs 80 and 86 is located below the seat 36 and infant and is generally aligned on or near a vertical axis passing through the center of mass of the seat 36 (and infant if therein). Such a position for the pivotable connection facilitates the easy pivotable adjustment of the seat to any of the desired positions. If the pivotable connection were above the center of mass or further offset therefrom, a greater force would be required from the operator to pivotably adjust between the desired positions.

The height of the seat 36 relative to the frame 32 can be adjusted by actuating the button housing 102 on the height adjust mechanism 82 which allows the main sleeve 84 to be slid relative to the front frame member 50 of the frame 32. Once the seat is at the desired height, the button housing 102 can be released and, under the force of the spring 104, the pin 100 can engage with one of the corresponding openings in the back of the front frame member 50 of the frame 32 to affix the sleeve 84 to the frame 32.

For collapsing the frame 32 to allow for easier transporting and/or storage of the high chair 30, the button 64 on the rear frame member 52 can be actuated and the rear frame member 52 pivoted into a position generally parallel with the front frame member 50. At this position, the button 64 should pop into the opening 62 defined to securely retain the frame 32 in this position. In order to return the frame 32 to the operational position, the button 64 can again be actuated and the rear frame member 52 pivoted to a position where the rear frame member 52 is angularly disposed relative to the front frame member 50 and the button 64 can pop into the opening 60 to securely retain the frame 32 in this operational position.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The invention claimed is:

1. A removable tray for use with a seating member for children, the seating member having a seat back and having two spaced apart portions for engagement with the removable tray, the tray comprising:

a support surface for supporting various objects with the tray, the support surface having a front surface located on an opposite side of the tray from the seat back when the tray is attached to the seating member; and an engagement mechanism attachable to the tray below the support surface for engagement with the spaced apart portions of the seating member, the engagement mechanism including a slidable actuation member extending outward from the support surface in the vicinity of the front surface and extending along a majority of the entire width of the tray, the actuation member being slidably actuable by moving the member inward in a direction substantially parallel to the support surface toward the seat back a sufficient amount to completely disengage the engagement mechanism from the spaced apart portions of the seating member.

2. A tray for use with and attachable to a feeding chair for children, comprising:

a support surface for supporting various objects thereon, the support surface having a pair of opposite sides; and a protruding member extending downward from the support surface at a position intermediate the two sides to prevent passage of a child between the tray and the chair, wherein the protruding member is pivotably and retractably mounted to the support surface to allow the protruding member to be moved between a blocking position to prevent passage of a child between the tray and the chair, and a non-blocking position to allow the tray to be placed on a planar surface such as a table while maintaining the support surface in an orientation generally parallel to the planar surface, and further wherein the protruding member includes a biasing member to urge the protruding member toward the blocking position.

3. A removable tray as defined in claim 1, wherein the engagement mechanism includes a right and a left engagement lever, each of which are pivotably mounted to an underside of the support surface, and each of which are also pivotably coupled to the slidable actuation member, the levers having engagement surfaces formed thereon for selective engagement with the spaced apart portions of the seating member, the levers being selectively pivotable between engaging and disengaging positions, wherein the levers are biased toward the engaging positions.

4. A high chair for children, comprising:

a main frame;

a support frame having a portion that is pivotably attachable to the main frame, the support frame being pivotable between an upright and a reclined position;

a latch mechanism to releasably secure the support frame in the upright or the reclined position, wherein the latch mechanism includes a pair of nested members, one being mounted on the main frame and one being mounted on the support frame, and the latch mechanism further includes an extended member to connect the two nested members and prevent pivotable movement therebetween, the extended member being selectively removable from at least one of the two nested members to selectively allow pivotable movement therebetween;

and a seat having a portion that is engageable and disengageable with the support frame to allow the support frame to support the seat from beneath the seat.

5. A high chair for children, comprising:

a frame including front and back frame members which are joined to each other at upper ends thereof;

a seat having a portion that is attachable to the frame; and a right and a left connecting mechanism for joining together the upper ends of the front and back frame members, the connecting mechanisms having at least one of the front and back frame members pivotably connected thereto, to allow the frame to be moved between collapsed and extended positions, wherein in the collapsed position the front and back frame members are generally parallel to each other and in the extended position the front and back frame members are in an intersecting angular relationship to each other;

wherein at least one of the connecting mechanisms has associated with it a latch mechanism for selectively and releasably securing the front and back frame members into each of said parallel and intersecting relationships, the latch mechanism including at least two openings defined in the connecting mechanism and a button provided on one of the frame members which is biased outward from the frame member and is movable into the frame member, the button being selectably received in one of the at least two openings to releasably secure the frame members relative to each other.

6. A high chair for children, comprising:

a main frame, including a pair of u-shaped frame members joined together;

a support frame having a portion that is pivotably and slidably attachable to the main frame;

a seat having a portion that is engageable and disengageable with the support frame to allow the support frame to support the seat from beneath the seat; and a tray which has a portion that is removably attachable to the seat;

wherein the seat includes indentations defined thereon for engagement with the tray, wherein the tray includes an actuation member and a release member which are pivotably attachable together, the release member including an engaging member to engage with the indentations on the seat and to disengage from the indentations when the actuation member is actuated.

7. A high chair as defined in claim 6, wherein the tray includes two release members, one located on either side of the actuation member.

8. A high chair as defined in claim 7, wherein the tray also includes a pair of side release members, one associated with each release member to release the release members in an alternative fashion from actuating the actuation member.

9. A high chair as defined in claim 6, wherein the engaging member of the release member includes two separate protrusions, spaced apart at a distance corresponding to the distance between two indentations in the seat.

10. A high chair as defined in claim 9, wherein the distance between the two protrusions corresponds to the distance between two protrusions having one empty protrusion therebetween.

11. A high chair for children, comprising:

a frame including front and back frame members which are pivotally connected along a pivot axis at a pivot point to each other at upper ends thereof;

a seat having a portion that is attachable to the frame; and a right and a left connecting mechanism for joining together the upper ends of the front and back frame members, the connecting mechanisms having at least one of the front and back frame members pivotably connected thereto, to allow the frame to be moved between collapsed and extended positions, wherein in the collapsed position the front and back frame members are generally parallel to each other and in the extended position the front and back frame members are in an intersecting angular relationship to each other, the connecting mechanisms having an outer surface oriented perpendicular to the pivot axis;

wherein at least one of the connecting mechanisms has associated with it a latch mechanism on the outer surface of the connecting mechanisms at a spaced apart location along the frame members from the pivot point for selectively and releasably securing the front and back frame members into each of said parallel and intersecting relationships.

12. A high chair as defined in claim 11, wherein the latch mechanism includes at least two openings defined in the connecting mechanism and a button provided on one of the frame members which is biased outward from the frame member and is movable into the frame member, the button being selectably received in one of the at least two openings to releasably secure the frame members relative to each other.

13. A high chair for children, comprising:

a main frame, including a pair of u-shaped frame members joined together;

a support frame having a portion that is pivotably and slidably attachable to the main frame; and a seat having a portion that is engageable and disengageable with the support frame to allow the support frame to support the seat from beneath the seat, wherein the seat is removably attachable to the support frame with an attachment mechanism, wherein the support frame includes an upper and a lower elongated horizontal member, and the attachment mechanism removably attaches the seat to the upper and lower members of the support frame;

wherein the attachment mechanism is affixed to the seat and includes a pair of recesses defined on the back of the seat to engage the upper member of the support frame and also includes an engagement mechanism on the bottom of the seat to engage the lower member of the support frame.

14. A high chair as defined in claim 13, wherein the engagement mechanism is pivotably mounted to the bottom of the seat, movable between an engaging position and a disengaging position, and biased toward the engaging position, the engagement mechanism having an inclined bottom surface thereon to move the engagement mechanism toward the disengaging position when the seat is moved from a removed position toward the lower member of the support frame, the engagement mechanism moving against the bias toward the disengaging position due to a camming nature of the inclined surface and the pivotable mounting, the bias moving the engagement mechanism back toward the engaging position when the seat is sufficiently moved toward the lower member of the support frame.

15. A high chair as defined in claim 14, wherein the engagement mechanism includes a recess defined on a back side thereof for engagement with the lower member of the support frame.

16. A high chair as defined in claim 13, wherein the engagement mechanism engages with the lower member of the support frame in a manner to self-tighten if the seat is lifted away from the lower member without actuating the engagement mechanism.

17. A high chair as defined in claim 13, wherein the engagement mechanism is centrally disposed adjacent the front of the seat bottom.

18. A high chair for children, comprising:

a main frame, including a pair of u-shaped frame members joined together;

a support frame having a portion that is pivotably and slidably attachable to the main frame, the support frame being pivotable between an upright and a reclined position;

a seat having a portion that is engageable and disengageable with the support frame to allow the support frame to support the seat from beneath the seat; and a latch mechanism to releasably secure the support frame in the upright or the reclined position, wherein the latch mechanism includes a pair of nested members, one being mounted on the main frame and one being mounted on the support frame, and the latch mechanism further includes an extended member to connect the two nested members and prevent pivotable movement therebetween, the extended member being selectively removable from at least one of the two nested members to selectively allow pivotable movement therebetween.

19. A high chair for children, comprising:

a main frame;

a support frame having a portion that is attachable to the main frame, the support frame including an upper and a lower elongated horizontal member; and a seat engageable and disengageable with the support frame to allow the support frame to support the seat from beneath the seat, wherein the seat is removably attachable to the upper and lower members of the support frame with an attachment mechanism, and further wherein the attachment mechanism is affixed to the seat and includes a pair of recesses defined on the back of the seat to engage the upper member of the support frame and also includes an engagement mechanism on the bottom of the seat to engage the lower member of the support frame.

20. A high chair as defined in claim 19, wherein the engagement mechanism is pivotably mounted to the bottom of the seat, movable between an engaging position and a disengaging position, and biased toward the engaging position, the engagement mechanism having an inclined bottom surface thereon to move the engagement mechanism toward the disengaging position when the seat is moved from a removed position toward the lower member of the support frame, the engagement mechanism moving against the bias toward the disengaging position due to a camming nature of the inclined surface and the pivotable mounting, the bias moving the engagement mechanism back toward the engaging position when the seat is sufficiently moved toward the lower member of the support frame.

21. A high chair as defined in claim 20, wherein the engagement mechanism includes a recess defined on a back side thereof for engagement with the lower member of the support frame.

22. A high chair as defined in claim 19, wherein the engagement mechanism is pivotably mounted to the bottom of the seat, and wherein the engagement mechanism includes a recess defined on a back side thereof for engagement with the lower member of the support frame, and wherein the relative location of the recesses on the back of the seat and the recess on the engagement mechanism and the shape of the recesses cause the engagement mechanism to self-tighten if the seat is lifted away from the lower member without actuating the engagement mechanism.

23. A high chair as defined in claim 19, wherein the engagement mechanism is centrally disposed adjacent the front of the seat bottom.

* * * * *